US007700879B2

(12) United States Patent
Watanabe

(10) Patent No.: US 7,700,879 B2
(45) Date of Patent: Apr. 20, 2010

(54) SHIELD CONDUCTOR AND METHOD OF PRODUCING THEREOF

(75) Inventor: Kunihiko Watanabe, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 327 days.

(21) Appl. No.: 11/793,333

(22) PCT Filed: Apr. 4, 2006

(86) PCT No.: PCT/JP2006/307149

§ 371 (c)(1),
(2), (4) Date: Jun. 19, 2007

(87) PCT Pub. No.: WO2006/107050

PCT Pub. Date: Oct. 12, 2006

(65) Prior Publication Data

US 2008/0156516 A1 Jul. 3, 2008

(30) Foreign Application Priority Data

Apr. 4, 2005 (JP) ..... 2005-107606
Mar. 29, 2006 (JP) ..... 2006-092117

(51) Int. Cl.
*H01B 7/00* (2006.01)

(52) U.S. Cl. ..... 174/102 R

(58) Field of Classification Search ..... 174/36, 174/110 R, 113 R, 116, 118, 120 R, 121 R, 174/102 R See application file for complete search history.

(56) References Cited

U.S. PATENT DOCUMENTS

| | | | | |
|---|---|---|---|---|
| 3,160,702 | A * | 12/1964 | Lapsley | 174/32 |
| 3,591,770 | A * | 7/1971 | Ando | 219/540 |
| 3,594,492 | A * | 7/1971 | Bahder et al. | 174/36 |
| 4,639,544 | A * | 1/1987 | Dableh et al. | 174/32 |
| 5,389,736 | A * | 2/1995 | Ziemek et al. | 174/36 |
| 6,806,418 | B2 * | 10/2004 | Donazzi et al. | 174/36 |
| 7,094,970 | B2 | 8/2006 | Kihira | |
| 2005/0224280 | A1 * | 10/2005 | Aisenbrey | 181/148 |
| 2006/0151195 | A1 * | 7/2006 | Donazzi et al. | 174/110 R |

FOREIGN PATENT DOCUMENTS

| | | |
|---|---|---|
| CN | 1574108 A | 2/2005 |
| JP | A 49-114077 | 10/1974 |
| JP | A 56-86410 | 7/1981 |
| JP | U 57-34906 | 2/1982 |
| JP | A 59-46713 | 3/1984 |
| JP | A 59-127321 | 7/1984 |
| JP | U 60-19109 | 2/1985 |
| JP | U 60-127609 | 7/1985 |
| JP | A 61-87411 | 5/1986 |
| JP | A 63-119109 | 5/1988 |
| JP | A 2004-171952 | 6/2004 |
| JP | A 2005-26110 | 1/2005 |
| WO | WO 00/36614 A1 | 6/2000 |

* cited by examiner

*Primary Examiner*—William H Mayo, III
(74) *Attorney, Agent, or Firm*—Oliff & Berridge, PLC

(57) ABSTRACT

An improved shield connector and a method of making the same include an electric wire having a conductor with an insulation coating and a metallic pipe. The electric wire is positioned in the metallic pipe. A filler is located inside the pipe, between the electric wire and the pipe, and the filler has a heat conductivity higher than that of air.

18 Claims, 14 Drawing Sheets

FIG.7

| | Conventional shield conductor (without filler) | | Improved shield conductor of the present embodiment (with filler) | |
|---|---|---|---|---|
| | Specifications | Weights | Specifications | Weights |
| Conductors | (Cross-sectional area per one piece=20sq) | 540g (3 pieces) | (Cross-sectional area per one piece=12.5sq) | 330g (3 pieces) |
| Synthetic resins | (Insulation coating alone) | 250g | (Insulation coating and filler) | 215g |
| Pipes | (Inner diameter=23mm) (Outer diameter=25mm) | 200g | (Inner diameter=18mm) (Outer diameter=20mm) | 160g |
| Totals | | 990g | | 705g |

SHIELD CONDUCTOR AND METHOD OF PRODUCING THEREOF

TECHNICAL FIELD

The present invention relates to a shield conductor and a method of producing thereof.

BACKGROUND ART

For example, in an electric vehicle or a hybrid vehicle, it is necessary to use a shield conductor as power supply lines to an inverter apparatus, and from the inverter apparatus to a drive motor. As the shield conductor used in such applications, there has been considered a structure in which a plurality of non-shield electric wires are enclosed with a shield member formed of a tubular braided wire, which is formed by weaving a thin metal wire into a mesh form, to electromagnetically shield them in a package.

However, in a vehicle, not only electromagnetic shielding of conductor lines, but also the protection of the electric wires (such as protection from rebounding stones during driving) needs to be considered since those shield conductors are wired on the bottom face of a vehicle body as well as in an engine room. For this reason, generally, a configuration in which a braided wire is enclosed with a protector made of synthetic resin is adopted; however, there is a problem that use of the protector will increase the number of parts.

Accordingly, the present applicants proposed a structure in which a non-shield electric wire is inserted into a metal pipe as described in Japanese Patent Laid-Open No. 2004-171952. According to this structure, since the metal pipe exerts both the function of electromagnetically shielding the electric wire and the function of protecting the electric wire from rebounding stones etc., the structure requires a fewer number of parts compared with a shield conductor using a shield member and a protector, and is also more advantageous in terms of strength than a synthetic resin protector.

DISCLOSURE OF THE INVENTION

However, a shield conductor using a pipe is problematic since an air layer exists between the electric wire and the pipe, the heat generated in the electric wire while power is applied is blocked by the air, which has a low heat conductivity, thus becoming less prone to being transferred to the pipe. Furthermore, since the pipe does not contain an airflow path to outside such as the gap in a stitch of a braided wire, a problem arises in that the heat generated in the electric wire tends to build up inside the pipe, and the temperature of the electric wire becomes high.

In this respect, the amount of heat generation when a predetermined current is applied to a conductor becomes less as the cross-sectional area of the conductor becomes larger, and the temperature rise value of the conductor due to heat generation is suppressed to be lower as the heat dissipation capability of the conductor line is high. Therefore, under a circumstance in which an upper limit of the electric wire temperature is specified from the heat resistance of the insulation coating etc., it is necessary for a shield conductor having a low heat dissipation efficiency as described above, to increase its cross-sectional area thereby suppressing the amount of heat generation.

However, increasing the cross-sectional area of the conductor means an increase in the diameter, and therefore the weight, of the shield conductor, against which some countermeasure is needed.

Thus there is a need in the art for a shield conductor utilizing a pipe with improved heat dissipating capability.

SUMMARY

The shield conductor of the present invention is configured to comprise an electric wire formed by enclosing a conductor with an insulation coating, a metallic pipe into which an electric wire is inserted, and a filler placed in the gap between an electric wire and a pipe and having a heat conductivity higher than that of air.

According to this configuration, the heat generated in the electric wire is transferred to the filler, and from the filler to the pipe to be released from the outer periphery of the pipe into the atmosphere. Since the filler has a heat conductivity higher than that of air, this configuration is superior in the performance of dissipating the heat generated in the electric wire compared to a configuration without a filler.

The electric wire may be, at least over part of its length, in a form in which the outer periphery of the insulation coating is kept in contact with the inner periphery of the pipe. This configuration causes the heat generated in the electric wire to be transferred directly to the pipe without passing through the filler thereby increasing the heat dissipation efficiency.

Forming the insulation coating for the electric wire by baking a formed resin onto the surface of the conductor will reduce the electric wire diameter, thereby allowing further weight reduction.

Moreover, a structure in which multiple electric wires of a baked-on insulation coating type are placed in a pipe and are then shielded with a sheath will make it possible to effectively prevent the electric wire from coming into contact with the inner wall of the pipe when the electric wire is inserted into the pipe. Furthermore, since the electric wire is formed of an electric wire of a baked-on insulation coating type, it is possible to reduce the necessary amount of the sheath as the diameter of the electric wire decreases and therefore to achieve a weight and cost reduction of the sheath, further leading to a weight and cost reduction of the entire shield conductor.

In producing the shield conductor of the present invention, a method may comprise inserting an electric wire into a pipe, and with one end portion of the pipe being provided with an injection opening and the other end portion of the pipe being opened upwardly, injecting a filler into the pipe from the injection opening, concurrently releasing the air in the pipe to outside from the foregoing upward opening at the other end portion.

The method may also comprise inserting an electric wire into a pipe, and injecting a filler from one end portion of the pipe while suctioning the air in the pipe from the other end portion of the pipe to be discharged to the outside.

Moreover, the production method may also comprise: forming a structure in which an electric wire having a baked-on insulation coating on the conductor surface is coated with a sheath, thereafter applying a filler onto the surface of the sheath, and inserting the sheath applied with the forgoing filler into the pipe.

According to the electric wire of the present invention, since the heat generated in the electric wire is effectively transferred to the pipe via the filler, the electric wire is not only superior in shielding performance, but also excels in heat dissipation performance, and therefore it is possible to reduce the diameter of the electric wire thereby achieving a weight reduction.

BRIEF DESCRIPTION OF THE DRAWINGS

FIG. 7 is a table to show the difference in the weight between the improved shield conductors of a prior art example and the present embodiment;

FIG. 14 illustrates production process 4 (inserting process) of the shield conductor of.

DETAILED DESCRIPTION OF THE PRESENT INVENTION

Figure 1:
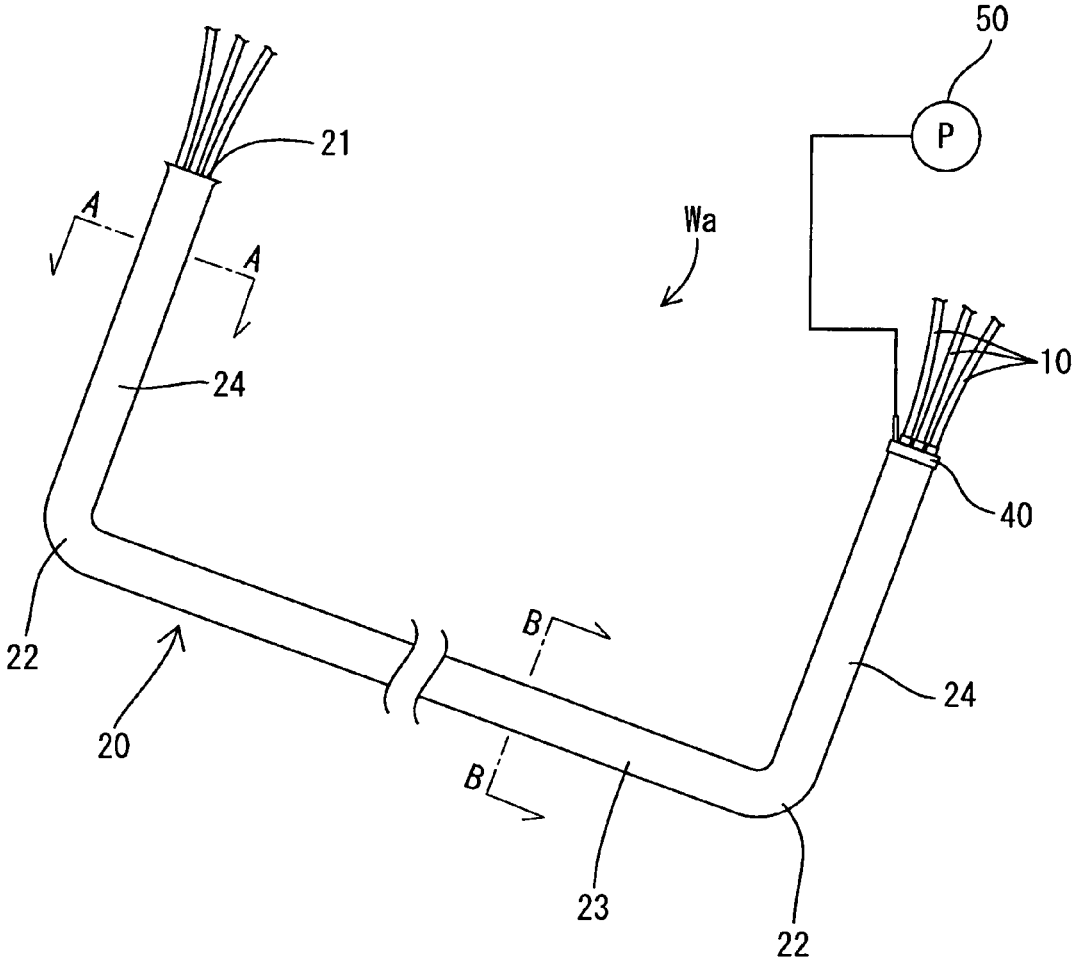
FIG. 1 is a side view of the shield conductor of an embodiment according to the present invention.
Figure 2:
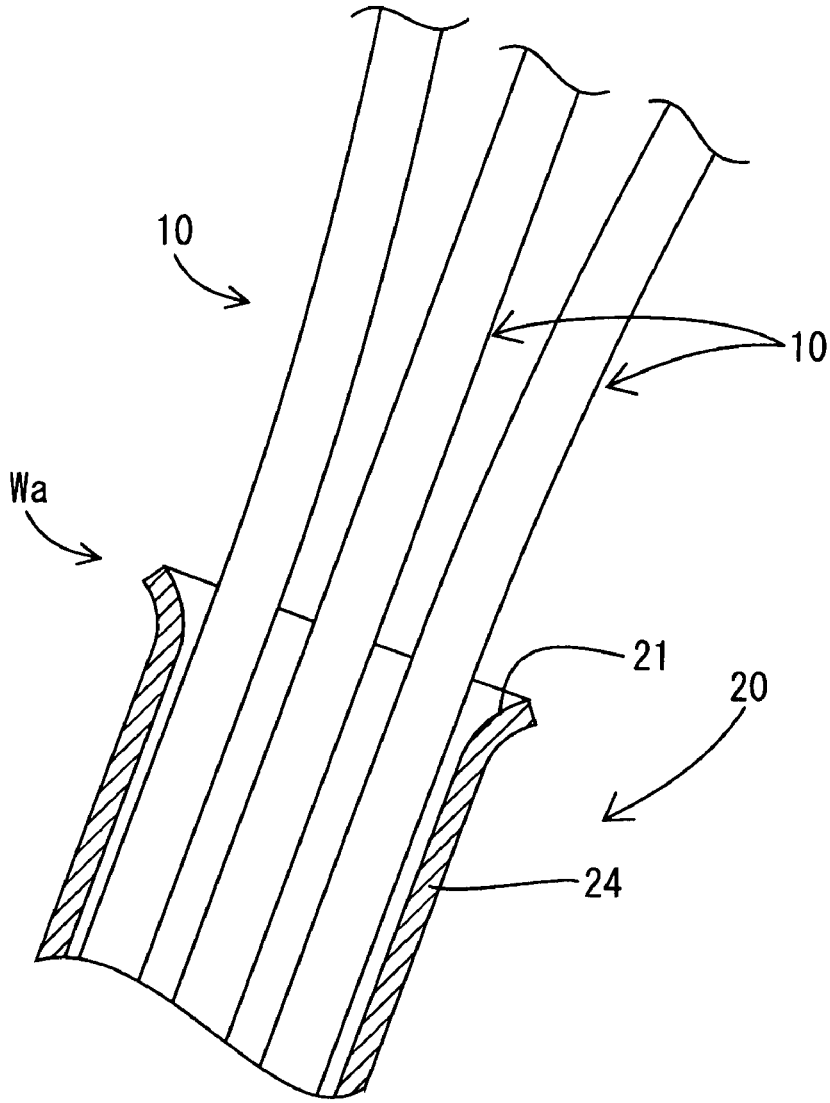
FIG. 2 is a partially enlarged longitudinal sectional view to show the end portion of the pipe on the injection opening side.
Figure 3:
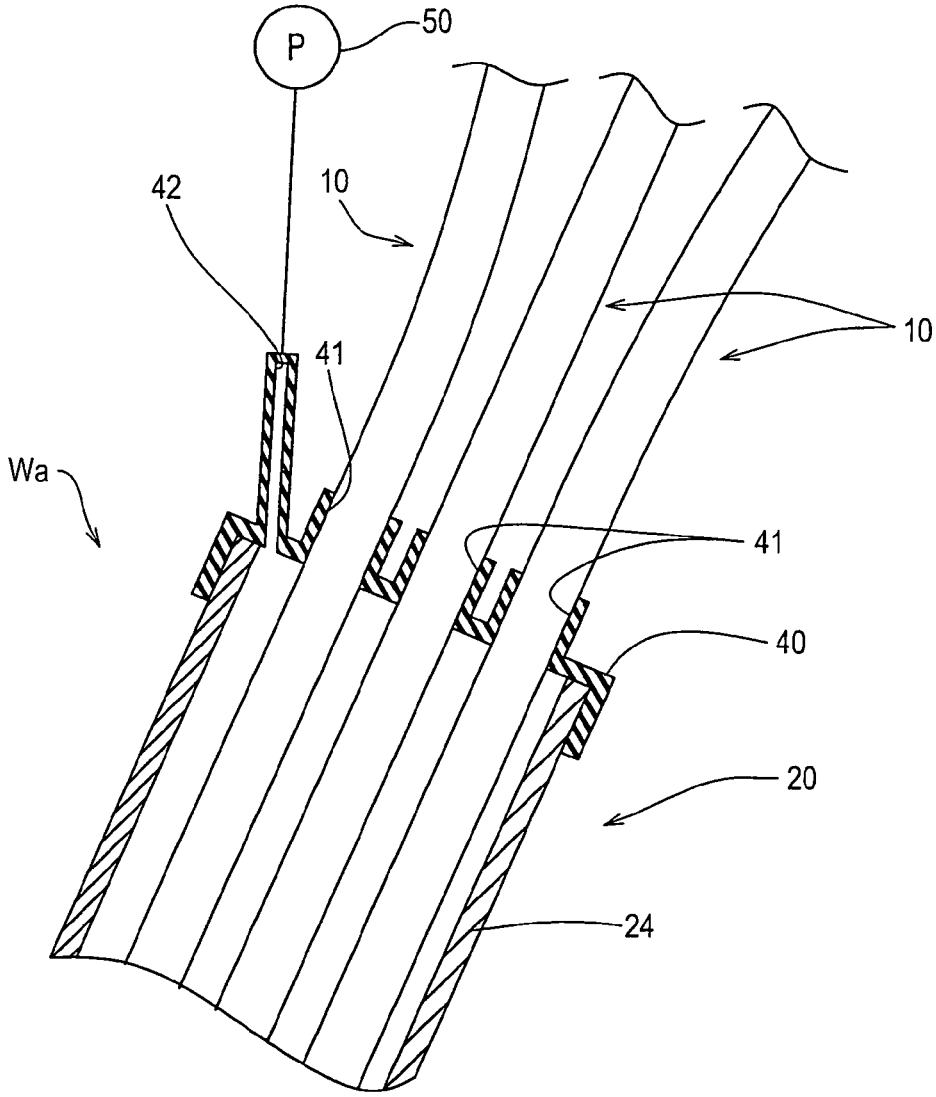
FIG. 3 is a partially enlarged longitudinal sectional view to show the end portion of the pipe on the exhaust side.

Hereinafter, an embodiment according to the present invention will be described with reference to FIGS. 1 to 7. The shield conductor Wa of the present embodiment is, for example, one disposed among apparatuses (not shown) constituting a drive power source in an electric vehicle, such as a battery, an inverter, and a motor. It is configured such that three non-shield type electric wires 10 are inserted into a pipe 20 which has both the function of electromagnetically shielding the three non-shield type wires 10 as a whole, and the function of protecting the electric wire from an impact from the outside such as a rebounding stone.

The electric wire 10 is in a form in which the outer periphery of a conductor 11 made of a metal (such as, for example, an aluminum alloy, a copper alloy, etc.) is enclosed by an insulation coating 12 made of a synthetic resin; and the conductor 11 is comprised of a twisted wire formed by weaving multiple thin wires (not shown) into a spiral-shape, or a single core wire. The electric wire 10 has a cross section in which both the conductor 11 and the insulation coating 12 are of a circular shape.

The pipe 20 is made of a metal (for example, an aluminum alloy, a copper alloy, stainless steel, etc.) and has a heat conductivity higher than that of air. The cross section of the pipe 20 forms a circular shape in the same way as the electric wire 10. Pipe 20 originally forms a straight line at time of manufacture. In a straight-line state, three electric wires 10 are inserted into the pipe 20, and both end portions of the electric wire 10 are drawn out to the outside of the pipe 20. The three electric wires 10 in the pipe 20 are adapted to be able to undergo relative displacement in a radial direction in the pipe 20 while keeping their positional relationship so as to form a generally barrel-stack form (a form which draws an equilateral triangle when the centers of the electric wires 10 are linked together). That is, it is configured such that a clearance is created between the electric wires 10, and between the electric wire 10 and the pipe 20. Then, this clearance facilitates the insertion operation of the electric wire 10 into the pipe 20. Then, after inserting the electric wire 10, both end portions of the pipe 20 are bent at about a right angle and in substantially same direction with the electric wire 10. And, a filler 30 of a synthetic resin fills the interior of the pipe 20, which is a gap between the pipe 20 and the electric wire 10. The filler 30 can be a HDI system two-component urethane resin which has a low viscosity in a molten, the injection of which will be described later, state is being used.

Next, the production process of shield conductor Wa will be described.

In advance, the pipe 20 is formed at one end portion with an injection opening 21 of which opening is deformed to be enlarged in a bell-mouth shape. A cover 40 is attached to the other end portion (exhaust side) of the pipe 20. The cover 40 is elastic and has an exhaust opening 42 formed in a tubular shape and three through holes 41 also formed in a tubular shape. Each through hole 41 is inserted with one electrical wire 10 respectively, and the exhaust opening 42 is connected to a suction pump 50. The opening edge of the pipe 20 and the cover 40 are kept in intimate contact in a fluid-tight manner, and the outer periphery of the electric wire 10 and the inner periphery of the through hole 41 are also kept in intimate contact in a fluid-tight manner.

Pipe 20 is held in a predetermined posture with a holding apparatus (not shown) such that the long portion 23 away from the end portions (the region between both bend portions 22) is positioned slightly oblique to horizontal, and both end portions 24 of the pipe 20 are oriented obliquely upward and the injection opening 21 is opened upwardly.

In this state, the suction pump 50 is operated to force the air in the pipe 20 to be discharged out of the pipe 20 through the exhaust opening 42, and filler 30 in a fluidic state (a molten state) is injected into the pipe 20 through the injection opening 21. The injected filler 30 passes through the gap between the pipe 20 and the electric wire 10 and flows gradually toward the cover 40 while filling up the gap. During this time, since the space in the pipe 20 which is closer to the exhaust opening 42 than the region filled with the filler 30 is in a negative pressure state due to the suction by the suction pump 50, the filler 30 is securely fed toward the cover 40 without being stopped in the middle of the pipe 20.

Then, when the space inside the pipe 20 is fully filled up with the filler 30 (since part of the filler 30 is pushed out of the pipe 20 through the exhaust opening 42), a leakage of the filler 30 from the exhaust opening 42 is detected thereby stopping the injection of the filler 30 as well as the suction by the suction pump 30. As so far described, the injection process of the filler 30 is completed such that the gap in the pipe 20 between the electric wire 10 and the pipe 20, and the gap between electric wires 10 are filled with the filler 30 without remaining air bubbles.

Figure 4:
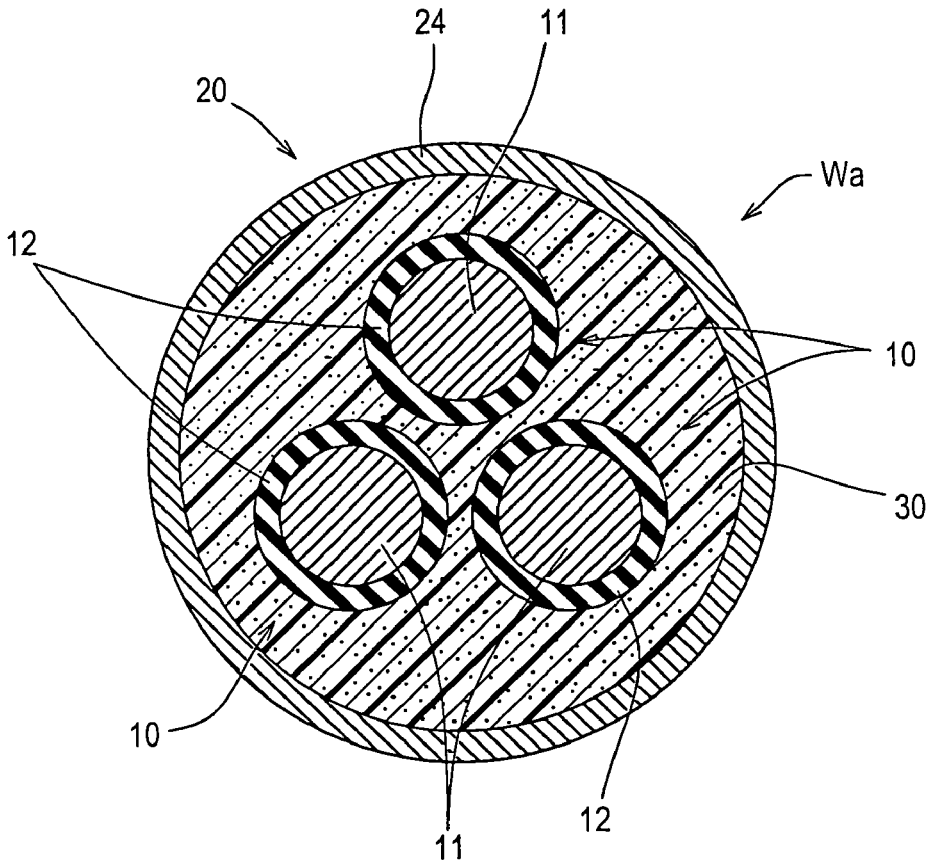
FIG. 4 is a sectional view taken along the line A-A in FIG. 1.

In both end portions 24 further above the bend portion 22 in the pipe 20 (a region of which axial line is approximately vertical and which is located between the bend portion 22 and the injection opening 21, and the region between the bend portion 22 and the end portion of the exhaust side where the cover 40 is attached), since the electric wire 10 is not displaced in the radial direction due to gravity, as shown in FIG. 4, three electric wires 10 are separated from each other and arranged in substantially triangular shape (barrel-stack form), and the outer periphery of the electric wire 10 and the inner periphery of the pipe 20 are kept in a separated state. That is, the filler 30 is interposed between the inner periphery of the pipe 20 and the outer periphery of the electric wire 10 as well as between the electric wires 10.

Figure 5:
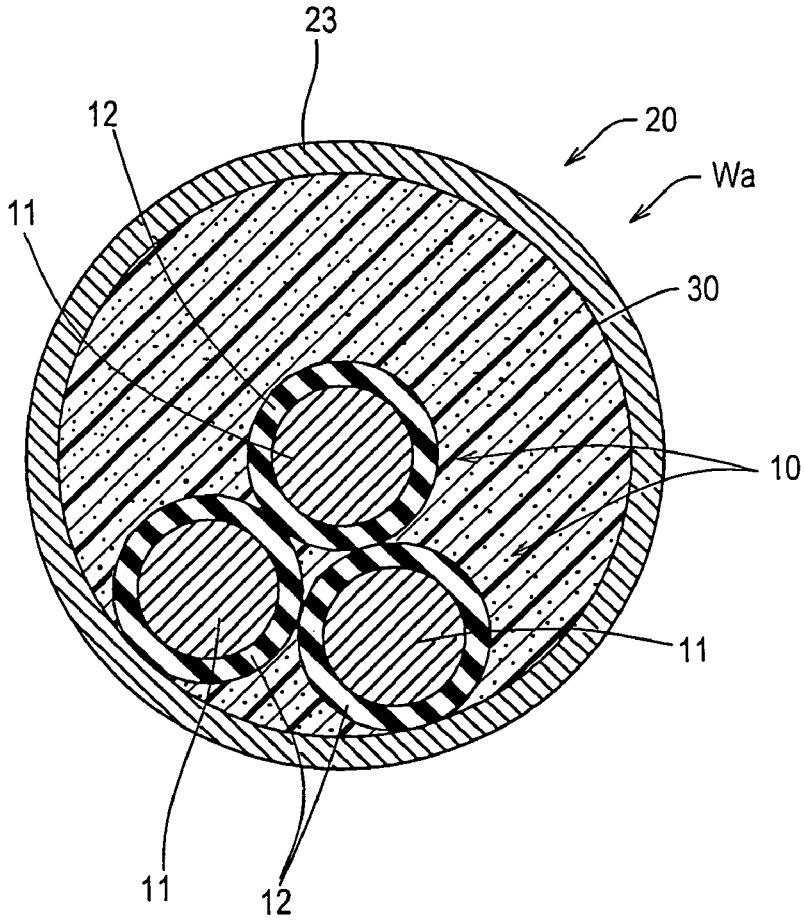
FIG. 5 is a sectional view taken along the line B-B in FIG. 1.

On the other hand, while the filler 30 is being injected, in the long portion 23 between the both bend portions 22 in the pipe 20 (the region which was held approximately horizontal), the three electric wires 10 are displaced downwardly due to gravity as shown in FIG. 5, and disposed in a barrel-stack form with the periphery of each being in abutment in a line contact manner with each other. Two of the three electric wires 10, which are located at lower positions are abutted (carried) on the inner periphery of the pipe 20 in a line contact manner.

In the present embodiment, since it is configured such that when injecting the filler 30 into the pipe 20 from the injection opening 21, the air inside the pipe 20 is forced to be discharged to the outside from the end portion opposite to the injection opening 21 in the pipe 20, there is no risk of occurrence of air buildup inside the pipe 20 and thus it is possible to securely fill the pipe 20 with the filler 30.

Further, as the production method of shield conductor Wa may be such that the filler 30 is injected with the exhaust opening 42 being oriented to open upwardly and without connecting the suction pump 50 to the exhaust opening 42. Air inside the pipe 20 is pushed out into the atmosphere from the exhaust opening 42 by the filler 30 as it moves toward the exhaust opening 42 (thereby filling the gap between the pipe 20 and the electric wire 10. Thus the risk of the occurrence of air buildup inside the pipe 20 is reduced, thereby making it possible to securely fill the pipe 20 with the filler 30.

Figure 8:
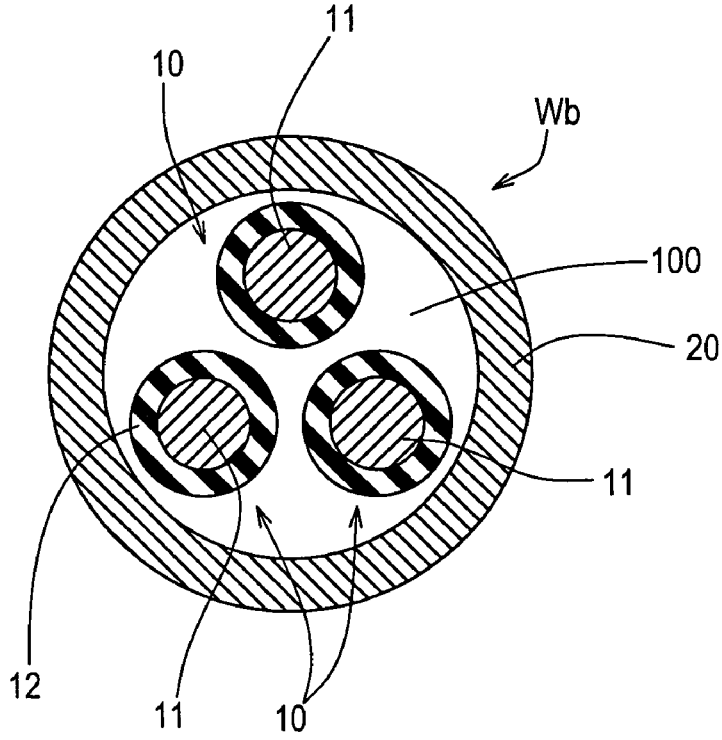
FIG.8 PRIOR ART
FIG. 8 is a cross-sectional view of the shield conductor of a prior art example.

When the filler 30 filling the pipe 20 solidifies, the shield conductor Wa is completed. In the case of the conventional shield conductor Wb shown in FIG. 8, since an air layer 100 exists between the electric wire 10 and the pipe 20, the heat generated in the electric wire 10 (while power is applied) is blocked by the air layer 100 having a lower heat conductivity and thus less prone to being transferred to the pipe 20. And, in addition to that, since there is no airflow path to the outside in the pipe 20 (like a gap of a stitch in a braided wire), the heat generated in the electric wire 10 is prone to being built up in the pipe 20 thus decreasing the heat dissipation.

On the other hand, since the shield conductor Wa of the present embodiment is configured so that the filler 30 of synthetic resin having a heat conductivity higher than that of air fills in the pipe 20, and so that the filler 30 is in surface contact with the outer periphery of the electric wire 10 and the inner periphery of the pipe 20. Therefore, the heat generated in the electric wire 10 is released into the atmosphere from the outer periphery of the pipe 20 through a path (1) by being transferred from the outer periphery of the insulation coating 12 of the electric wire 10 to the filler 30, conducted through the filler 30, and transferred from the filler 30 to the inner periphery of the pipe 20, or through a path (2) of being transferred directly from the outer periphery of the insulation coating 12 of the electric wire 10 to the inner periphery of the pipe 20 without passing through the filler 30. Therefore, a high performance in dissipating the heat generated in the electric wire 10 is achieved. Especially in the area where the outer periphery of the electric wire 10 is in direct contact with the inner periphery of the pipe 20, the heat dissipation efficiency is high since the heat conducting path from the electric wire 10 to the pipe 20 is short.

Further, since the filler 30 is made of synthetic resin, it is possible to charge the synthetic resin into the pipe 20 easily and securely by keeping it in a fluidic state such as a molten state or a pellet state. Further, in a state in which the synthetic resin (filler 30) has solidified, since the relative displacement of the electric wires 10 in the pipe 20 or the relative displacement of the electric wire 10 with respect to the pipe 20 can be restricted, it is possible to prevent the wear of the insulation coating 12 caused by the rubbing between the electric wires 10 or between the pipe 20 and the electric wire 10.

Moreover, in a region where the filler 30 is interposed in the gap between adjacent electric wires 10, it is possible to prevent the rubbing between the insulation coatings 12 of the electric wires 10. Similarly, in a region where the filler 30 is included in the gap between the outer periphery of the electric wire 10 and the inner periphery of the pipe 20, it is possible to securely prevent the rubbing between the insulation coating 12 of the electric wire 10 and the pipe 20.

Figure 6:
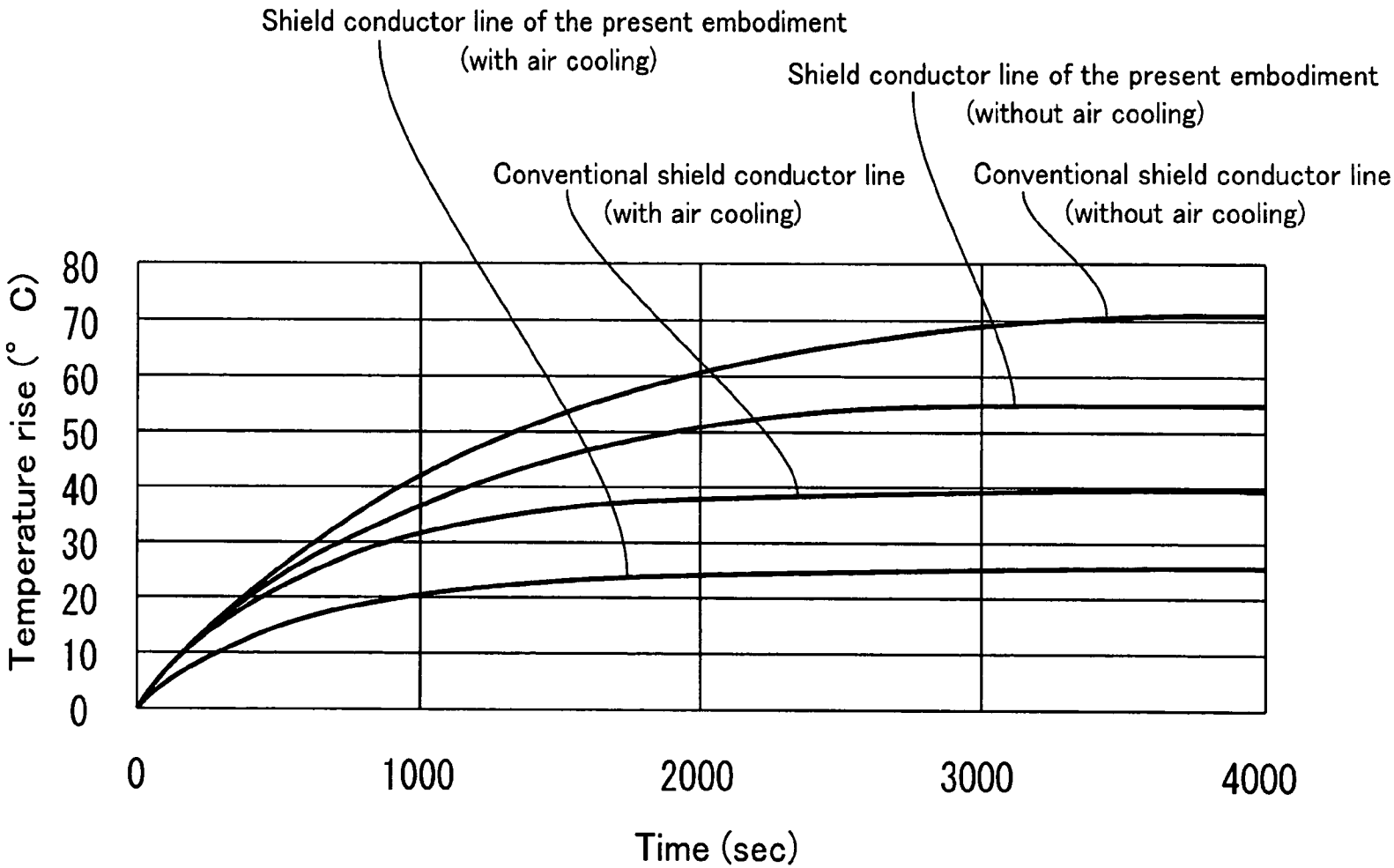
FIG. 6 is a graph to show the heat dissipation performance of shield conductors of a prior art example and the present embodiment.

As so far described, the shield conductor Wa of the present embodiment is superior in heat dissipation efficiency, and FIG. 6 illustrates a graph of the experimental results of the comparison of the heat dissipation efficiency between the conventional shield conductor Wb and the shield conductor Wa of the present embodiment which is configured to be in the form shown in FIG. 4 over its whole length. The conventional shield conductor Wb and the shield conductor Wa of the present embodiment shared the electric wire 10 and the pipe 20, and the cross-sectional area (per one wire) of the conductor 11 of the electric wire 10 was 20 sq (square millimeters), the outer diameter of the insulation coating 12 was 8.2 mm, the inner diameter of the pipe 20 was 23 mm, and the outer diameter of the pipe 20 was 25 mm. A current of 100 A was applied to the electric wire 10 continuously for 4000 seconds, and the temperature rise value from the state before applying the current was measured. The points of temperature measurement were in the boundary surface between the outer periphery of the conductor 11 and the inner perimeter of the insulation coating 12. Further, in the experiment, a comparison was made between a case in which the pipe 20 was cooled by blowing air at 2.4 m/sec (air cooling) and a case without air blow.

First, comparing the no-cooling cases, at a point in time after a lapse of 4000 seconds, while the temperature rise value is about 70° C. for the conventional shield conductor Wb (which was not filled with the filler 30), the temperature rise value is suppressed to about 55° C. for the shield conductor Wa of the present embodiment which was filled with the filler 30. Also, comparing the cooling cases, at a point in time after a lapse of 4000 seconds, while the temperature rise value is about 40° C. for the conventional shield conductor Wb (which was not filled with the filler 30), the temperature rise value is suppressed to 25° C. for the shield conductor Wa of the present embodiment (which was filled with the filler 30). Regardless of with and without air cooling, for the shield conductor Wa of the present embodiment, the temperature rise values were suppressed to a value about 15° C. lower compared with the conventional shield conductor Wb, and this temperature difference of 15° C. is regarded as the heat dissipation performance by the filler 30. Also, comparing the cases with and without air cooling, it is seen that the temperature rise values are about 30° C. lower for the cases with air cooling regardless of with and without the filler 30.

The weight reduction of the shield conductor Wa can be expected as an effect an improved heat dissipation performance has been improved as described above. That is, although it is expected that when a predetermined current is applied to the electric wire 10 (conductor 11), the smaller the cross-sectional area of the conductor 11 is, the larger the heat generation of the electric wire 10 becomes; however, when the heat dissipation performance is superior like the present embodiment, it is possible to suppress the temperature rise value of the electric wire 10 to below even if the heat generation of the electric wire 10 is large. Therefore, in a circumstance in which an upper limit is set to the temperature rise value of the electric wire 10 such as in the case of an electric vehicle, the permissible heat generation in the electric wire 10 will become relatively larger by changing the conventional shield conductor Wb to the shield conductor of the present embodiment Wa which is superior in heat dissipation. And, the fact that the permissible heat generation in the electric wire 10 becomes relatively larger means that the minimum cross-sectional area of the usable conductor 11 can be reduced in an circumstance where an upper limit is set to the temperature rise value in the electric wire 10 and a reduction in weight and diameter of the shield conductor Wa can be achieved by reducing the cross-sectional area of the conductor 11.

The Table in FIG. 7 shows the comparison data per 1 meter of the conventional shield conductor Wb without the filler 30 and an improved shield conductor (not shown) obtained by reducing the weight of the shield conductor Wa of the present embodiment, regarding the minimum cross-sectional area, associated size of the pipe 20 of the conductor 11 usable under a circumstance in which an upper limit of the temperature rise value in the electric wire 10 is specified. The permissible temperature rise value of the electric wire 10 is 40° C., the conductor 11 is a copper twisted wire, the thickness of the insulation coating 12 is 1.1 mm, and the pipe 20 is made of an aluminum alloy.

For the conventional shield conductor Wb, to satisfy a permissible temperature rise value of 40° C., the cross-sectional area of one conductor 11 needs to be not less than 20 sq. Given that the cross-sectional area of the conductor 11 is 20 sq, the total weight of three conductors 11 will be 540 g, the total weight of the insulation coating 12 for three electric wires 10 will be 250 g, the weight of the pipe 20 will be 200 g, and the grand total weight of the shield conductor Wb will be 990 g.

In contrast, for the improved shield conductor of the present embodiment, to satisfy a permissible temperature rise value of 40° C., the minimum cross-sectional area of one conductor 11 can be reduced as small as 12.5 sq. Therefore, given that the cross-sectional area of the conductor 11 is 12.5 sq, the total weight of three conductors 11 will be 330 g, the total weight of the synthetic resin including the insulation coating 12 of three electric wires 10 and the filler 30 in combination will be 215 g, the weight of the pipe 20 which has been reduced in diameter in accordance with the size of the conductor 11 will be 160 g, and the grand total weight of the improved shield conductor will be 705 g.

That is, the improved shield conductor of the present embodiment can achieve a weight reduction of 285 g per 1 m (about 30%) compared to the conventional shield conductor Wb. Further, by changing the material of the conductor 11 to aluminum which has a density lower than that of copper, it is possible to achieve a further weight reduction.

Embodiment 2

Figure 9:
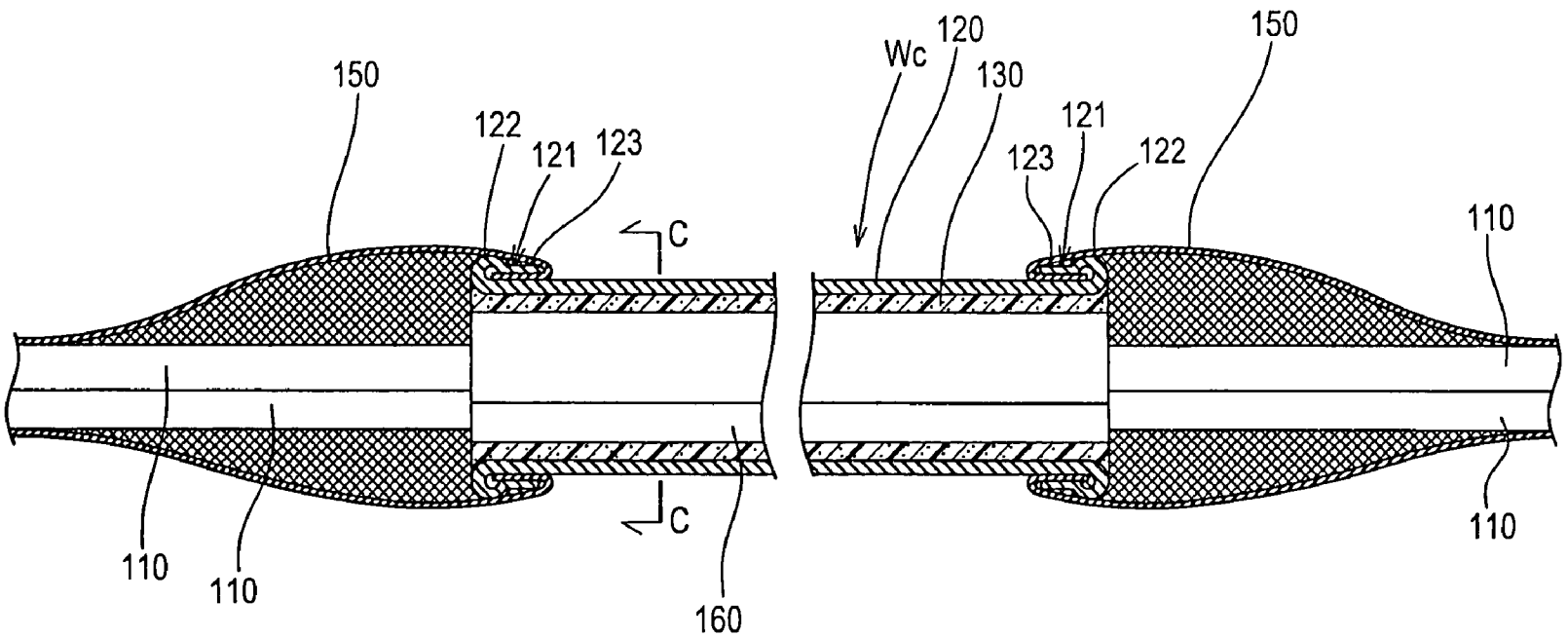
FIG. 9 is a schematic side sectional view to exemplify the shield conductor according to an embodiment according to the present invention.
Figure 10:
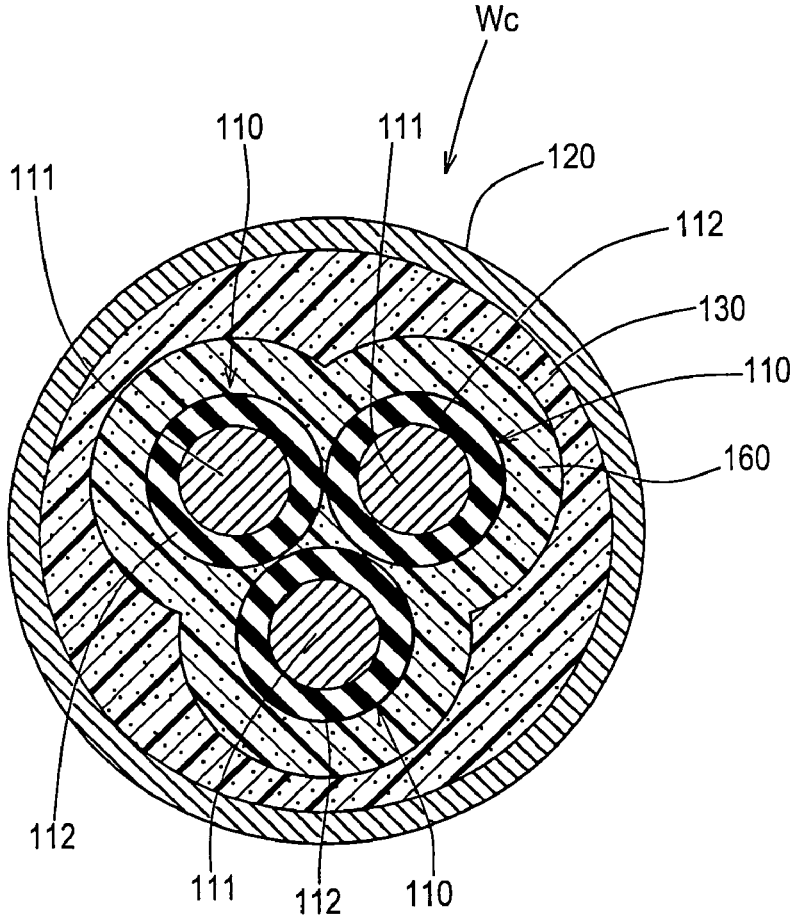
FIG. 10 is a sectional view taken along the line C-C in FIG. 9.

Next, the shield conductor Wc according to the embodiment 2 will be described with reference to FIGS. 9 to 14. FIG. 9 is a schematic side sectional view to exemplify the shield conductor Wc according to embodiment 2, and FIG. 10 is a sectional view taken along the line C-C of FIG. 9. The shield conductor Wc of the present embodiment, which is also wired among apparatuses (not shown) constituting, for example, a drive power source in an electric vehicle, such as a battery, an inverter, and a motor is configured such that three non-shield type electric wires 110 are inserted into a pipe 120 which combines a package shielding function and a electrical-wire protecting function.

As shown in FIG. 10, the electric wire 110 is formed by baking an insulation coating 112 onto a single core conductor 111 made of a metal (such as an aluminum alloy and a copper alloy), and is configured as, for example, an enameled wire. The cross-sectional profile of the electric wire 110 is configured such that both the conductor 111 and the insulation coating 112 are shaped into a circular shape.

As the insulation coating 112, although any resin which can be baked onto the conductor 111 is applicable, for example, polyamide-imide can be suitably used, and others (such as polyurethane, polyester, polyester-imide, etc.) may also be used.

Further, a plurality of electric wires 110 are coated with a sheath 160 made of resin in the interior of the pipe 120. As shown in FIG. 9, the sheath 160 is disposed in a form covering the whole length of the pipe 120 and, as shown in FIG. 10, is configured to be one size smaller than the inner diameter of the pipe 120. In the present embodiment, three electric wires 110 are combined into a barrel-stack form and bundled by the sheath 160.

The pipe 120 is made of metal (such as an aluminum alloy and a copper alloy), and has a heat conductivity higher than that of air. The cross-section of the pipe 120 forms a perfect circle in the same way as the electric wire 110. Three electric wires 110 are inserted into the pipe 120, and both end portions of the electric wire 110 are drawn out to the outside of the pipe 120. Inside the pipe 120, three electric wires 110 are bundled by the above-described sheath 160 while keeping their positional relationship so as to form a generally barrel-stack form (a form which draws an equilateral triangle when the centers of the electric wires 110 are linked together). Inside the pipe 120, a filler 130 fills in between the inner wall of the pipe 120 and the sheath 160. In the present embodiment, the filler is formed of a silicon-base synthetic resin.

Moreover, as shown in FIG. 9, a flexible shield member 150 is connected to end portions of the pipe 120. This flexible shield member 150 is formed of a braided wire and is configured to enclose the extended portion from the pipe 120 in the electric wire 110. At the front end portion of the pipe 120, there is formed (integrally with the pipe 120) a tubular fixing portion 121 which is formed by being bent so as to be folded back toward the outer periphery side all around the perimeter of the pipe. An end portion of the fixing portion 121 is configured to be a bend portion 122 forming an approximately semi-circle arc, and the region in the fixing portion 121 closer to the center than to the bend portion 122 provides a presser portion 123 which has an approximately constant diameter and forms a cylindrical shape concentric with the pipe 120. As shown in FIG. 9, the flexible shield member 150 is sandwiched between the outer periphery of the pipe 120 and the fixing portion 11 with its one end portion being reversely folded back, and is held to be conductibly connected to the pipe 120.

Next, the method of producing the shield conductor Wc relating to embodiment 2 will be described.

Figure 11:
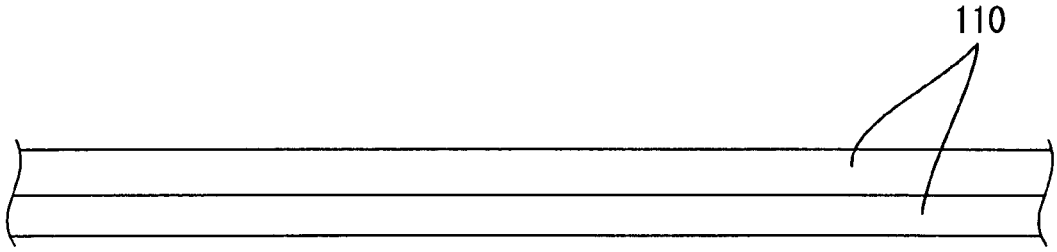
FIG. 11 illustrates production process 1 of the shield conductor of an embodiment according to the present invention.
Figure 12:
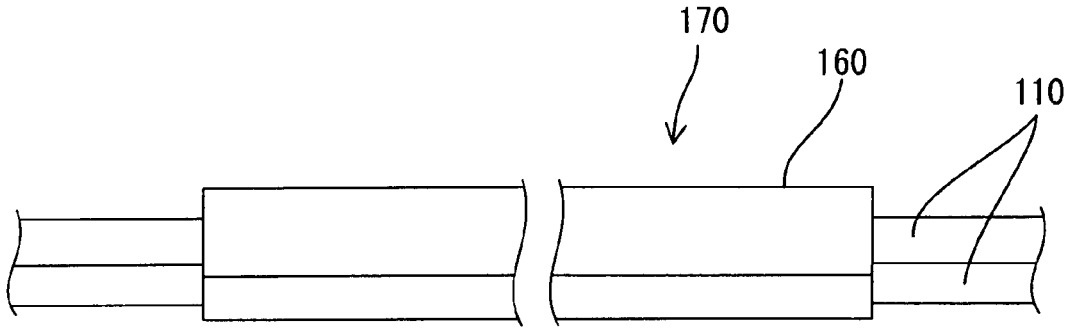
FIG. 12 illustrates production process 2 (sheath coating process) of the shield conductor.
Figure 13:
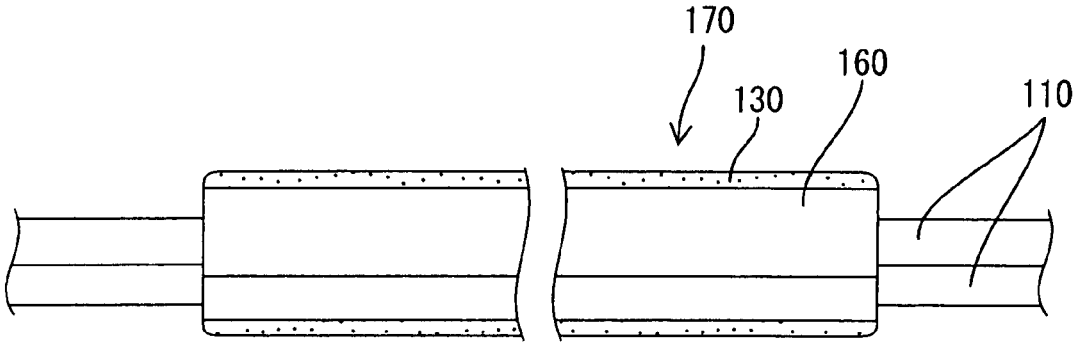
FIG. 13 illustrates production process 3 (filler application process) of the shield conductor.
Figure 14:
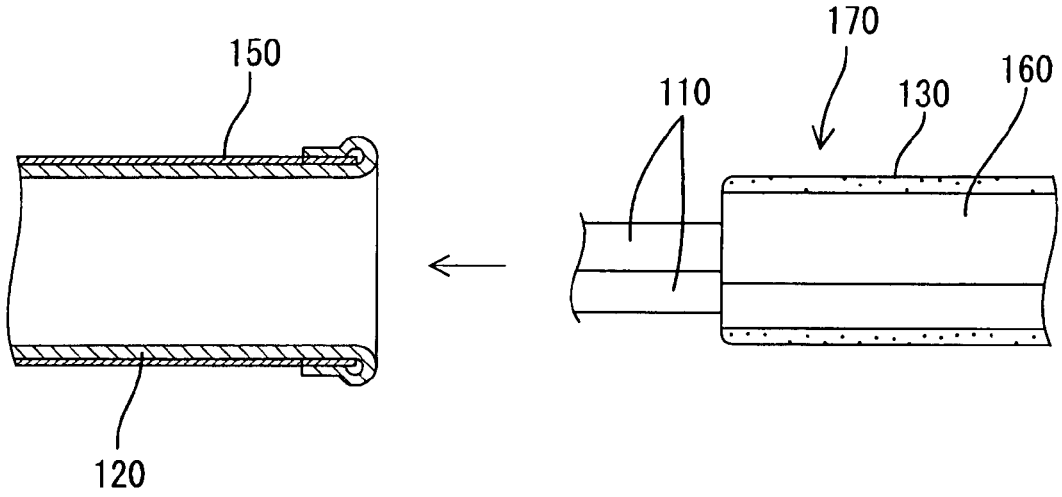

First, as shown in FIG. 11, three of the above described electric wires 110 (in this case, an enameled wire formed by baking an insulation coating thereto) are prepared. Subsequently, as shown in FIG. 12, a structure 170 is formed by coating part of the three electric wires 110 with the above described sheath 160. Then, as shown in FIG. 13, a filler 130 in a molten state is applied to the surface of the sheath 160 in the structure 170. The filler 130 of the present embodiment is a type which is made to be a molten state in the application process, and to solidify after the structure 170 is disposed in the pipe. Thereafter, as shown in FIG. 14, the portion of the sheath 160 in the structure 170 to which the filler 130 is applied is inserted into the pipe 120 to obtain a shield conductor Wc as shown in FIG. 9. Further, FIG. 14 shows a state immediately after the flexible shield member 150 is attached by crimping, and the configuration of FIG. 9 will be obtained by folding back the shield member from this state.

Although adopting the configuration in which an electric wire 110 of baked-on insulation coating type is disposed in the pipe 120 in the same way as the present embodiment will be preferable in that the diameter of the electric wire 110 can be reduced, etc., a problem arises in that the insulation coating 112 may be damaged when it is inserted into the pipe 120. Then, in the above described production method, when inserting the electric wire 110 of baked-on insulation coating type into the pipe 120, a structure 170 in which the electric wire 110 is coated with the sheath 160 is formed and after applying the filler 130 thereto, the structure 170 is inserted into the pipe 120, thereby making it possible to prevent the electric wire 110 from coming into contact with the inner wall of the pipe 120 during assembly thereby preventing the damage of the insulation coating 112, and to appropriately charge the filler 130 between the sheath 160 and the pipe 120.

As so far described the present embodiment is configured, as with embodiment 1, such that a filler 130 fills in the gap between the electric wire 110 in the pipe 120 and the pipe 120, the heat generated in the electric wire 110 is transferred to the filler 130 via the sheath 160, then from the filler 130 to the pipe 120, and released from the outer periphery of the pipe 120 into the atmosphere. Since the filler 130 has a heat conductivity higher than that of air, the present embodiment is superior in the performance of releasing the heat generated in the electric wire 110 compared with one in which the filler 130 is not used.

Further, since the filler 130 is formed of a synthetic resin, it is possible to fill in the pipe 120 easily and securely by keeping the synthetic resin in a fluidic state such as a molten state and/or a pellet state. And, when the synthetic resin solidifies, it can restrict the relative displacement between the electric wires in the pipe and the relative displacement of the electric wire with respect to the pipe, thereby making it possible to prevent the wear of the insulation coating caused by the rubbing between the electric wires and between the pipe and the electric wire.

Further, since the electric wire 110 is formed by baking the insulation coating 112 onto the conductor 111, it is easy to effectively reduce the diameter of the electric wire 110 thereby providing a convenient structure for weight reduction. Specifically, since the electric wire 110 is formed of an enameled wire, it is possible to effectively improve the voltage endurance and heat resistance as well as to decrease the diameter of the electric wire 110.

Further, since the electric wire 110 of baked-on insulation coating type is coated with sheath 160 in the pipe 120, it is possible to effectively prevent the electric wire 110 from coming into contact with the inner wall of the pipe 120 upon assembly etc. Moreover, since the electric wire 110 is formed of an electric wire of baked-on insulation coating type, it is also possible to decrease the required amount of the sheath as the diameter of the electric wire is decreased.

Other Embodiments

The present invention will not be limited by the embodiments described with reference to the above description and the drawings, as the embodiments such as follows will also be included in the technical scope of the present invention.

(1) Although three electric wires were inserted into one pipe in the above described embodiments, the number of electric wires to be inserted into one pipe may be any of one, two, or not less than four according to the present invention.

(2) Although the filler described as being made of a two-component urethane resin in the above referenced embodiments, other kinds of synthetic resins may be used as the filler according to the present invention.

(3) Although the filler described as being a flexible solid (synthetic resin) in the above referenced embodiments, the filler may be a liquid (such as water and oil) according to the present invention. In this case, it is possible to further improve the heat dissipation capability by circulating the filler (liquid) so as to pass through the pipe and an out-of-pipe flow path which has a heat dissipation capability.

(4) Although the filler described as being of one kind in the above referenced embodiments, multiple kinds of fillers may fill in one pipe according to the present invention. In this case, the filler may be a combination of solids, or a solid and a liquid.

(5) Although described as being in the above referenced embodiments that the pipe and the electric wire are bent together after inserting the electric wire into the pipe, the electric wire may be inserted after bending the pipe according to the present invention.

(6) Although the filler filled in the interior of the pipe (which had been bent) is described in the above referenced embodiments, the pipe may be bent after charging the filler in a fluidic state into a straight pipe, according to the present invention. At this time, if the solidified synthetic resin has no flexibility, it is necessary to bend the pipe before solidification, but if the solidified synthetic resin has flexibility, the pipe may be bent after the filler has solidified.

(7) Although the filler in a fluidic (molten) state was injected into the pipe with the electric wire being inserted into the pipe is described in the above referenced embodiments, the electric wire and the filler may be integrated outside the pipe to insert them into the pipe according to the present invention.

(8) Although it was described in the above referenced embodiments such that no air buildup would occur in the gap between the electric wire in the pipe and the pipe, it may be configured such that a small volume of air buildup will remain in the gap between the electric wire in the pipe and the pipe according to the present invention.

(9) Although the filler was injected from an end portion of the pipe in the above-described embodiments, it is also possible to inject the filler from an injection opening opened in the outer periphery of the pipe and to close the injection opening after the filler is charged, according to the present invention.

(10) Although it was configured in the above-described embodiments that the electric wires were disposed in a barrel-stack form inside the pipe, the electric wires may be disposed in a line or may be aligned in rows and columns, according to the present invention.

(11) Although the pipe was described as having a circular cross section in the above-described embodiments, the cross section of the pipe may be a non-circle shape (generally polygonal shapes including rectangular, elliptical, trapezoidal, and parallelogram shapes) according to the present invention.

(12) Although the space in the pipe was forced to be evacuated by connecting a suction pump to the exhaust opening when injecting the filler into the pipe in the above-described embodiments, the filler may be injected with the exhaust opening being opened to the atmosphere outside the pipe and without connecting a suction pump to the exhaust opening, according to the present invention.

The invention claimed is:

1. A shield conductor comprising:

an electric wire including a conductor and an insulation coating;

a metallic pipe, wherein the electric wire is positioned in the metallic pipe; and a filler located in a gap inside the pipe between the electric wire and the pipe, the filler having a heat conductivity higher than that of air, wherein:

the filler is a synthetic resin, and the gap is substantially filled up with the filler.

2. The shield conductor according to claim 1, wherein the outer periphery of said insulation coating is in contact with the inner periphery of said pipe.

3. The shield conductor according to claim 2, wherein a plurality of electric wires are positioned in the pipe, further wherein the plurality of electric wires are coated with a sheath in the interior of said pipe.

4. The shield conductor according to claim 1, wherein said insulation coating is formed by baking a resin positioned on the surface of said conductor.

5. The shield conductor according to claim 4, wherein a plurality of electric wires are positioned in the pipe, further wherein the plurality of electric wires are coated with a sheath in the interior of said pipe.

6. The shield conductor according to claim 1, wherein a sheath layer is positioned on the insulation coating.

7. The shield conductor according to claim 6, wherein a resin layer is positioned on the sheath layer.

8. The shield conductor according to claim 1, wherein a pipe end includes an exhaust opening which is capable of letting air out of the pipe.

9. The shield conductor according to claim 1, wherein the filler is fluid.

10. The shield conductor according to claim 1, wherein the filler is a plurality of pellets.

11. A method of producing a shield conductor having a configuration comprising the steps of:

inserting an electric wire into a metallic pipe such that a gap between the electric wire and the pipe is formed;

providing a first end portion of said pipe having an injection opening and a second end portion of said pipe opened upwardly; and injecting a filler into said pipe from said injection opening, and concurrently releasing air in said pipe to the outside from the second end portion, wherein the filler has a heat conductivity higher that air.

12. A method of producing a shield conductor according to claim 11, wherein the filler is filled in a fluid form.

13. A method of producing a shield conductor according to claim 11, wherein the filler is filled in a pellet form.

14. A method of producing a shield conductor according to claim 11, wherein the second end portion includes an exhaust opening which allows air to leave the pipe.

15. A method of producing a shield conductor according to claim 11, further comprising forming a sheath over the electric wire.

16. A method of producing a shield conductor according to claim 15, further comprising forming a resin layer over the sheath.

17. A method of producing a shield conductor having a configuration comprising the steps of:

inserting an electric wire into a metallic pipe such that a gap between the electric wire and the pipe is formed;

injecting a filler from one end portion of the pipe while suctioning air in the pipe to discharge it to the outside from an opposite end portion of the pipe, wherein the pipe is filled with the filler having a heat conductivity higher than that of air.

18. A method of producing a shield conductor having a configuration comprising the steps of:

inserting an electric wire into a metallic pipe such that a gap between the electric wire in the pipe and the pipe is formed;

coating the electric wire with a sheath; and coating the sheath by injecting a filler, the filler having a heat conductivity higher than that of air.

* * * * *